US008211204B2

(12) United States Patent
Yasuda et al.

(10) Patent No.: US 8,211,204 B2
(45) Date of Patent: Jul. 3, 2012

(54) SELF-FLUXING PELLETS FOR BLAST FURNACE AND METHOD FOR MANUFACTURING THE SAME

(75) Inventors: Eisaku Yasuda, Kakogawa (JP); Nobuhiro Hasegawa, Kakogawa (JP); Yoshiyuki Matsui, Kakogawa (JP); Shuji Kitayama, Kakogawa (JP)

(73) Assignee: Kobe Steel, Ltd., Kobe-shi (JP)

( * ) Notice: Subject to any disclaimer, the term of this patent is extended or adjusted under 35 U.S.C. 154(b) by 191 days.

(21) Appl. No.: 12/680,855

(22) PCT Filed: Dec. 15, 2008

(86) PCT No.: PCT/JP2008/072774

§ 371 (c)(1),
(2), (4) Date: Mar. 30, 2010

(87) PCT Pub. No.: WO2009/081784

PCT Pub. Date: Jul. 2, 2009

(65) Prior Publication Data

US 2010/0206131 A1 Aug. 19, 2010

(30) Foreign Application Priority Data

Dec. 20, 2007 (JP) ..... 2007-329065

(51) Int. Cl.
*C22B 1/16* (2006.01)

(52) U.S. Cl. ..... 75/323; 75/773; 23/313 R

(58) Field of Classification Search ..... 75/327, 75/773; 23/313 R

See application file for complete search history.

(56) References Cited

U.S. PATENT DOCUMENTS 5,127,940 A * 7/1992 Sugiyama et al. ..... 75/327

FOREIGN PATENT DOCUMENTS

| | | |
|---|---|---|
| JP | 50 21917 | 3/1975 |
| JP | 63 219534 | 9/1988 |
| JP | 1 136937 | 5/1989 |
| JP | 2 179804 | 7/1990 |
| JP | 3 247723 | 11/1991 |

OTHER PUBLICATIONS

Sugiyama et al. Abstract of JP 02179804 A, published Jul. 12, 1990.*
Sugiyama et al. Written translation of JP 02-179804 A. Published Jul. 12, 1990.*
Inoue, Katsuhiko et al., "$MgO$-$A1_2O_3$-$SiO_2$-$CaO$-$FeO_x$ Gosei 5 Genkei ni Okeru Nanka Tokusei", Journal of the Iron & Steel Institute of Japan, vol. 66, No. 11, pp. S667, ISSN: 0021-1575, Sep. 5, 1980.

* cited by examiner

*Primary Examiner* — George Wyszomierski
*Assistant Examiner* — Tima M McGuthry Banks
(74) *Attorney, Agent, or Firm* — Oblon, Spivak, McClelland, Maier & Neustadt, L.L.P.

(57) ABSTRACT

Provided are self-fluxing pellets for a blast furnace, characterized in that a $CaO/SiO_2$ mass ratio C/S is 0.8 or more and a $MgO/SiO_2$ mass ratio M/S is 0.4 or more; when an iron content (mass %) in the entire pellet is represented by % TFe, % TFe is 65% or less; and a temperature Ts (unit: ° C.) at which the pressure loss starts to increase sharply in a loaded high-temperature reduction test and which is calculated by the equation below is 1290° C. or higher:

$$Ts=110\times C/S+100\times M/S+25\times\%\ TFe-480.$$ Equation:

7 Claims, No Drawings

SELF-FLUXING PELLETS FOR BLAST FURNACE AND METHOD FOR MANUFACTURING THE SAME

This application is a national stage application of PCT/JP08/72774 filed Dec. 15, 2008.

TECHNICAL FIELD

The present invention relates to self-fluxing pellets (also referred to as "pellets" hereinafter) used as an iron raw material for blast furnaces and to methods for making the pellets. In particular, it relates to self-fluxing pellets suited to be charged into a blast furnace together with sintered ore and to a method for making the pellets.

BACKGROUND ART

The applicant of the present invention has pursued development of techniques for modifying self-fluxing pellets to be used as an iron raw material for a blast furnace from the 1970s to 1980s and completed development of the techniques with which self-fluxing pellets (self-fluxing dolomite pellets) having good reducibility at high temperature (hereinafter referred to as "high-temperature reducibility") can be manufactured by blending, as CaO and MgO sources, limestone and dolomite with iron ore such that the resulting blended raw material has a $CaO/SiO_2$ mass ratio of 0.8 or more and a $MgO/SiO_2$ mass ratio of 0.4 or more, pelletizing the blended raw material into raw pellets, and burning the raw pellets (Refer to Patent Documents 1 and 2).

The applicant of the present invention has also pursued development of burden distribution control techniques for blast furnaces concurrently with the development of techniques for modifying the self-fluxing pellets, and has completed development of center coke charging technologies that can dramatically improve air and liquid permeabilities in blast furnaces (refer to Non-Patent Document 1).

The use of the self-fluxing dolomite pellets and application of the center coke charging techniques have made it possible to stably and efficiently produce pig iron in blast furnaces that use both pellets and sintered ore as the iron raw material with large quantities of pulverized coal injected into the furnaces.

The self-fluxing dolomite pellets (may be simply referred to as "self-fluxing pellets" or "pellets" hereinafter) have a $CaO/SiO_2$ mass ratio (abbreviated as "C/S") and a $MgO/SiO_2$ mass ratio (abbreviated as "M/S") adjusted to particular values or higher by adding limestone and dolomite as the auxiliary raw materials to the iron ore; however, the amounts of limestone and dolomite blended are desirably reduced as much as possible to reduce the cost of manufacturing the pellets.

In order to meet the recent rapid increase in steel demand, the production of pig iron needs to be increased further. For blast furnaces that use both sintered ore and pellets as the iron raw material, pellets that have better high-temperature reducibility and that can further increase the productivity under high-level coal injection operation are desirably provided.

According to the knowledge subsequently gained by the applicant, it has been found that the high-temperature reducibility of the self-fluxing dolomite pellets is not solely determined by defining C/S and M/S but is also in no small measure influenced by the iron ore grade of the pellets (i.e., the iron grade of the iron ore used). In other words, it has been found that the optimum combination ranges for C/S and M/S vary according to the iron ore grade of the pellets.

However, the quantitative determination of the degree of such an influence has not been systematically investigated so far, and little is known about a more suitable C/S and M/S combination range that takes into account the iron ore grade of the pellets.

Non-Patent Document 1: Matsui et. al, "Blast Furnace Operational Technology and Central Gas Flow Intension for Center Coke Charging at Kobe Steel", R&D Kobe Steel Engineering Reports, Vol. 55, No. 2, September 2005, pp. 9-17

Patent Document 1: Japanese Examined Patent Application Publication No. 3-77853

Patent Document 2: Japanese Examined Patent Application Publication No. 3-77854

DISCLOSURE OF INVENTION

Problems to be Solved by the Invention

An object of the present invention is to clarify a more suitable combination range of the $CaO/SiO_2$ mass ratio and the $MgO/SiO_2$ mass ratio that takes into account the iron ore grade of the self-fluxing pellets and to provide self-fluxing pellets that cost less and have better high-temperature reducibility highly suitable as a blast furnace iron raw material to be used with sintered ore and a method for manufacturing the pellets.

Means for Solving the Problems

The present invention provides a self-fluxing pellet for a blast furnace, characterized in that a $CaO/SiO_2$ mass ratio C/S is 0.8 or more and a $MgO/SiO_2$ mass ratio M/S is 0.4 or more; when an iron content (mass) in the entire pellet is represented by % TFe, % TFe is 65% or less; and a temperature Ts (unit: ° C.) at which the pressure loss starts to increase sharply in a loaded high-temperature reduction test and which is calculated by the equation below is 1290° C. or higher:

$$Ts=110\times C/S+100\times M/S+25\times\%\ TFe-480 \quad \text{Equation:}$$

The present invention also provides a method for manufacturing self-fluxing pellets for a blast furnace, including a raw material blending step of blending auxiliary raw materials containing CaO and MgO with iron ore so that the $CaO/SiO_2$ mass ratio and the $MgO/SiO_2$ mass ratio of the resulting blended raw material are 0.8 or more and 0.4 or more, respectively, that when the iron content (mass %) in the entire pellets is represented by % TFe, % TFe is 65% or less, and that a temperature Ts at which the pressure loss starts to increase sharply in a loaded high-temperature reduction test and which is calculated by the equation below is 1290° C. or higher; a pelletizing step of pelletizing the blended raw material into raw pellets; and burning step of heating and burning the raw pellets at 1220° C. to 1300° C. to form self-fluxing pellets:

$$Ts=110\times C/S+100\times M/S+25\times\%\ TFe-480 \quad \text{Equation:}$$

Advantages

According to the present invention, the $CaO/SiO_2$ mass ratio C/S and the $MgO/SiO_2$ mass ratio M/S of the self-fluxing pellets are set to particular values or higher, and the temperature Ts at which the pressure loss starts to increase sharply and which is estimated on the basis of C/S, M/S, and % TFe is set equal to or higher than 1290° C., which is the temperature at which the pressure loss of the sintered ore starts to increase sharply. Thus, when the self-fluxing pellets are used in combination with the sintered ore as the raw material for a blast furnace, the width of the cohesive zone in the blast furnace is assuredly prevented from increasing and air permeability can be ensured. Thus, the productivity of the blast furnace can be further increased.

BEST MODES FOR CARRYING OUT THE INVENTION

[Structure of Self-Fluxing Pellets for a Blast Furnace According to the Present Invention]

Self-fluxing pellets for a blast furnace according to the present invention are characterized in that the $CaO/SiO_2$ mass ratio C/S is 0.8 or more and the $MgO/SiO_2$ mass ratio M/S is 0.4 or more, that, when the iron content (mass %) in the entire pellets is represented by % TFe, % TFe is 65% or less, and that the temperature Ts (unit: ° C.) at which the pressure loss in a loaded high-temperature reduction test starts to increase sharply and which is calculated by equation (1) below is 1290° C. or higher:

$$Ts=110\times C/S+100\times M/S+25\times\%\ TFe-480 \qquad \text{Equation (1)}$$

A more preferable range for % TFe is 64% or less.

% TFe is also referred to as "total iron content".

Individual constitutional features of the present invention will now be described in further detail.

(Slag Composition)

When the $CaO/SiO_2$ mass ratio and the $MgO/SiO_2$ mass ratio that define the slag composition of the self-fluxing pellets are set to particular values (0.8 and 0.4) or higher and the temperature at which the pressure loss starts to sharply increase and which is estimated by taking into account the iron ore grade (% TFe) is set equal to or higher than 1290° C., which is the temperature at which the pressure loss of the sintered ore starts to increase sharply, softening and burning-through temperatures of the pellets at the time of high-temperature reduction can be maintained at a temperature the same as or higher than that of the sintered ore. As a result, the high-temperature reducibility of the pellets is improved and the width of the cohesive zone in a blast furnace can be maintained at substantially the same width as in the case of using the sintered ore alone.

The process of deriving equation (1) above will now be described.

The inventors of the present invention fabricated pellets by properly adjusting the blending ratios of limestone, dolomite, and serpentinite relative to a particular iron ore raw material in an actual pellet plant so as to sequentially change the three parameters, namely, % TFe, C/S, and M/S, as shown in Table 1. The pellets were subjected to a loaded high-temperature reduction test to measure the temperature at which the pressure loss starts to increase sharply. The results are also shown in Table 1.

TABLE 1

| % TFe (mass %) | C/S (mass ratio) | M/S (mass ratio) | Temperature at which pressure loss starts to increase sharply (° C.) |
|---|---|---|---|
| 62.3 | 1.42 | 0.63 | 1300 |
| 62.8 | 1.42 | 0.69 | 1330 |
| 63.3 | 1.42 | 0.77 | 1319 |
| 63.1 | 1.5 | 0.77 | 1321 |
| 62.9 | 1.6 | 0.77 | 1329 |
| 62.7 | 1.6 | 0.88 | 1331 |
| 62.9 | 1.5 | 0.88 | 1312 |
| 63.1 | 1.42 | 0.88 | 1314 |
| 62.7 | 1.6 | 0.88 | 1340 |

TABLE 1-continued

| % TFe (mass %) | C/S (mass ratio) | M/S (mass ratio) | Temperature at which pressure loss starts to increase sharply (° C.) |
|---|---|---|---|
| 63.1 | 1.42 | 0.88 | 1338 |
| 63.3 | 1.42 | 0.77 | 1326 |

It was assumed that the degrees of influence of the three parameters, i.e., % TFe, C/S, and M/S, on the temperature at which the pressure loss starts to increase sharply can be subject to first-order approximation. Multiple regression analysis was conducted using the results shown in Table 1 to obtain the relationship represented by equation (1) above.

The loaded high-temperature reduction test involves simulating the reduction pattern in elevating temperatures in a blast furnace. As shown by the test conditions below, a predetermined amount of a sample is packed into a graphite crucible and a reducing gas is passed therethrough under a particular load and the elevating temperature while measuring the reduction ratio by off-gas analysis, the contraction ratio of the sample-packed layer by using a strain gauge, and the pressure loss of the sample-packed layer by using a differential pressure gauge.

[Test Conditions for Loaded High-Temperature Reduction Test]

Inner diameter of graphite crucible: 43 mm

Amount of sample: about 87 g (packing height: about 33.5 mm)

Load: 1.0 kgf/cm$^2$ (=9.80665×104 Pa)

Temperature: [room temperature→1000° C.]×10° C./min, [1000° C.→end of burn-through]×5° C./min Reducing gas: [30 vol % CO+70 vol % $N_2$]7.2 NL/min The temperature at which the pressure loss starts to increase sharply is the temperature at which the rate of increase in pressure loss of the sample-packed layer first reaches 50 mm $H_2O$/min (=490.3325 Pa/min) or higher. The pressure loss of the sample-packed layer increases sharply when the sample has started to melt. Accordingly, the temperature at which the pressure loss increases sharply is equivalent to the temperature at the top surface of the cohesive layer in the blast furnace.

The temperature at which the pressure loss of the sintered ore starts to increase sharply is set to 1290° C. on the basis of FIG. 23 in a published document (Sunahara et. al, Tetsu-to-Hagane, vol. 92 (2006) No. 12, pp. 183-192) showing the relationship between the temperature and the pressure loss in a loaded high-temperature softening test of sintered ore (test simulating the elevated temperature reduction pattern in a blast furnace as in the loaded high-temperature reduction test described above).

As described above, C/S must be 0.8 or more but is preferably 1.0 or more, more preferably 1.2 or more, and particularly preferably 1.4 or more. M/S must be 0.4 or more, but is preferably 0.5 or more, more preferably 0.6 or more, and particularly preferably 0.7 or more. The temperature Ts at which the pressure loss starts to increase sharply as estimated by equation (1) above is equal to or higher than 1290° C., i.e., the temperature at which the pressure loss of the sintered ore starts to increase sharply, but is preferably 1300° C. or more, more preferably 1310° C. or more, and particularly preferably 1320° C. or more.

However, when C/S, M/S, and the temperature Ts at which the pressure loss starts to increase sharply are excessively high, CaO and MgO components do not easily turn into slag when burning the pellets. Thus, the strength of the burned pellets decreases and the quantities of the limestone and dolomite used as the CaO and MgO sources increase, resulting in an increase in cost. Thus, C/S is preferably 2.0 or less, more preferably 1.8 or less, and most preferably 1.6 or less. M/S is preferably 1.1 or less, more preferably 1.0 or less, and particularly preferably 0.9 or less. The temperature Ts at which the pressure loss starts to increase sharply is preferably 1370° C. or less, more preferably 1360° C. or less, and particularly preferably 1350° C. or less.

The self-fluxing pellets that simultaneously satisfy both the iron ore grade and the slag composition have good high-temperature reducibility. When the pellets are used in combination with the sintered ore as the raw material for a blast furnace, the width of the cohesive zone in the blast furnace is prevented from increasing and air permeability can be ensured. Thus, the productivity of the blast furnace can be further increased.

[Method for Manufacturing the Self-Fluxing Pellets for Blast Furnaces According to the Present Invention]

The self-fluxing pellets for blast furnaces according to the present invention can be manufactured as follows, for example.

(Raw Material Blending Step)

For example, limestone and dolomite, which are auxiliary raw materials containing CaO and MgO, are blended according to the iron grade of the iron ore (pellet feed) serving as an iron material so that the $CaO/SiO_2$ mass ratio is adjusted to 0.8 or more (preferably 1.0 or more, more preferably 1.2 or more, and particularly preferably 1.4 or more), the $MgO/SiO_2$ mass ratio is adjusted to 0.4 or more (preferably 0.5 or more, more preferably 0.6 or more, and particularly preferably 0.7 or more), and the temperature Ts at which the pressure loss starts to increase sharply as defined by equation (1) above is adjusted to 1290° C. or more (preferably 1300° C. or more, more preferably 1310° C. or more, and particularly preferably 1320° C. or more). The iron ore and the auxiliary raw materials may be ground with a ball mill or the like beforehand or after they are blended if necessary so that the grain size of 80 mass % or more of the blended raw material is made to be 44 μm or less.

(Pelletizing Step)

Raw pellets are formed by adding an adequate amount of water to the blended raw material and pelletizing the resulting mixture with a pan pelletizer or a drum pelletizer serving as a pelletizer.

(Burning Step)

The raw pellets formed as above are layered onto a travelling grate of a grate kiln or a straight grate serving as a burning apparatus and a high-temperature gas is passed through the pellet layer to conduct stages of drying, removal of water (only when necessary), and pre-heating. The pellets are then heated and burned with a high-temperature gas of 1220° C. to 1300° C. in a rotary kiln in the case where a grate kiln is used or on a travelling grate in the case where a straight grate is used, thereby giving self-fluxing pellets. The temperature of the heating and burning may be adequately adjusted in the above-described temperature range according to the type of iron ore used, the $CaO/SiO_2$ mass ratio, the $MgO/SiO_2$ mass ratio, etc.

The iron ore grade and the slag composition of the self-fluxing pellets obtained as above satisfy the $CaO/SiO_2$ mass ratio and the $MgO/SiO_2$ mass ratio defined by the present invention as well as the condition that the temperature Ts at which the pressure loss starts to increase sharply as defined by equation (1) above is equal to or higher than 1290° C.

EXAMPLES

In order to confirm the effects brought about by using. the self-fluxing pellets of the present invention as the iron raw material to be used with sintered ore in blast furnaces, a loaded high-temperature reduction test was conducted on mixtures prepared by sequentially varying the ratio at which actual self-fluxing pellets satisfying the iron ore grade and slag composition defined by the present invention and actual sintered ore are blended to measure the temperature at which the pressure loss starts to increase sharply.

Self-fluxing dolomite pellets manufactured in a pellet plant in the Kakogawa Works of the applicant were used as the actual fluxing pellets. Self-fluxing sintered ore manufactured in a sintering plant in the Kakogawa Works of the applicant was used as the actual sintered ore. Their compositions are shown in Table 2. As shown in the table, the self-fluxing pellets used in EXAMPLES satisfy the iron ore grade and the slag composition (C/S≧0.8, M/S≧0.4, and value of equation (1)≧1290° C.) defined by the present invention.

TABLE 2

| | Component (mass %) | | | | | | $CaO/SiO_2$ mass | $MgO/SiO_2$ mass | Value of equation (1) |
|---|---|---|---|---|---|---|---|---|---|
| | T.Fe | FeO | $SiO_2$ | CaO | $Al_2O_3$ | MgO | ratio | ratio | (° C.) |
| Self-fluxing pellets | 61.9 | 0.61 | 2.90 | 3.79 | 1.28 | 2.28 | 1.31 | 0.79 | 1291 |
| Sintered ore | 56.4 | 6.7 | 5.3 | 10.8 | 1.72 | 0.88 | 2.04 | 0.17 | — |

The observed temperatures at which the pressure loss started to increase sharply in the loaded high-temperature reduction test are shown in Table 3 below.

TABLE 3

| Sample No. | Blending ratio (mass %) Self-fluxing pellets | Sintered ore | Temperature at which pressure loss starts to increase sharply (° C.) |
|---|---|---|---|
| 1 | 0 | 100 | 1277 |
| 2 | 25 | 75 | 1283 |
| 3 | 50 | 50 | 1284 |
| 4 | 75 | 25 | 1304 |
| 5 | 100 | 0 | 1317 |

As shown in Table 3, the observed temperature at which the pressure loss starts to increase sharply is 1277° C. for the sintered ore used in the Example (Sample No. 1), whereas the observed temperature at which the pressure loss starts to increase sharply for the self-fluxing pellets is 1317° C. (Sample No. 5), i.e., higher than that of the sintered ore. When mixtures of the pellets and the sintered ore are used, the temperature at which the pressure loss starts to increase sharply becomes higher than in the case where only the sintered ore is used. It has also been found that the temperature at which the pressure loss starts to increase sharply approaches that of the pellets alone as the blending ratio of the pellets increases (Sample Nos. 2 to 4).

These results confirmed that when self-fluxing pellets that satisfy the component definition of the present invention are used, the width of the cohesive zone in the blast furnace can be assuredly prevented from increasing when the pellets are used as the blast furnace iron raw material together with the sintered ore.

The invention claimed is:

1. A self-fluxing pellet for a blast furnace, characterized by a $CaO/SiO_2$ mass ratio C/S of 0.8 or more; a $MgO/SiO_2$ mass ratio M/S of 0.4 or more; an iron content (mass %) represented by % TFe of 65% or less; and a temperature Ts (unit: ° C.) of 1310° C. or higher when Ts is calculated by the equation below:

$$Ts=110\times C/S+100\times M/S+25\times\%\ Tfe-480. \quad \text{Equation:}$$

2. The self-fluxing pellet for a blast furnace of claim 1, wherein the $CaO/SiO_2$ mass ratio C/S of the self-fluxing pellet is 1.4 or more.

3. The self-fluxing pellet for a blast furnace of claim 1, wherein the Ts of the self-fluxing pellet is 1320° C. to 1370° C.

4. A self-fluxing pellet for a blast furnace, characterized by a $CaO/SiO_2$ mass ratio C/S of 1.4 or more; a $MgO/SiO_2$ mass ratio M/S of 0.6 or more; an iron content (mass %) represented by % TFe of 64% or less; and a temperature Ts (unit: ° C.) of 1290° C. or higher when Ts is calculated by the equation below:

$$Ts=110\times C/S+100\times M/S+25\times\%\ Tfe-480. \quad \text{Equation:}$$

5. A method for manufacturing self-fluxing pellets for a blast furnace, comprising:

(1) blending auxiliary raw materials containing CaO and MgO with iron ore so that (a) the $CaO/SiO_2$ mass ratio and the $MgO/SiO_2$ mass ratio of the resulting blended raw material are 0.8 or more and 0.4 or more, respectively, (b) the iron content (mass %) in the entire pellets is as represented by % Tfe is 65% or less, and (c) a temperature Ts is 1310° C. or higher when Ts is calculated by the equation below:

$$Ts=110\times C/S+100\times M/S+25\times\%\ Tfe-480; \quad \text{Equation:}$$

(2) pelletizing the blended raw materials into raw pellets; and (3) burning the raw pellets at 1220° C. to 1300° C. to form self-fluxing pellets.

6. The method for manufacturing self-fluxing pellets for a blast furnace of claim 5, wherein the $CaO/SiO_2$ mass ratio C/S of the self-fluxing pellet is 1.4 or more.

7. The method for manufacturing self-fluxing pellets for a blast furnace of claim 5, wherein the Ts of the self-fluxing pellets is 1320° C. to 1370° C.

* * * * *